US009052169B2

(12) United States Patent
Laporte et al.

(10) Patent No.: US 9,052,169 B2
(45) Date of Patent: Jun. 9, 2015

(54) TARGET LAUNCHING MACHINE

(75) Inventors: Jean-Michel Laporte, Biot (FR); Jean-Marc Fouques, Claviers (FR)

(73) Assignee: Laporte Holding (FR)

( * ) Notice: Subject to any disclaimer, the term of this patent is extended or adjusted under 35 U.S.C. 154(b) by 5 days.

(21) Appl. No.: 13/994,823

(22) PCT Filed: Dec. 16, 2011

(86) PCT No.: PCT/EP2011/073103

§ 371 (c)(1),
(2), (4) Date: Jun. 17, 2013

(87) PCT Pub. No.: WO2012/080489

PCT Pub. Date: Jun. 21, 2012

(65) Prior Publication Data

US 2013/0269667 A1 Oct. 17, 2013

(30) Foreign Application Priority Data

Dec. 17, 2010 (FR) ..... 10 60667

(51) Int. Cl.

| | |
|---|---|
| ***F41J 9/18*** | (2006.01) |
| ***F41J 9/32*** | (2006.01) |
| ***F41J 9/00*** | (2006.01) |
| ***F41J 9/24*** | (2006.01) |
| *F41J 9/30* | (2006.01) |

(52) U.S. Cl.
CPC ..... *F41J 9/18* (2013.01); *F41J 9/32* (2013.01); *F41J 9/24* (2013.01)

(58) Field of Classification Search
CPC ..... F41J 9/18; F41J 9/32; F41J 9/30
USPC ..... 124/6, 7, 8, 46, 47, 81
See application file for complete search history.

(56) References Cited

U.S. PATENT DOCUMENTS

| | | | | | |
|---|---|---|---|---|---|
| 1,552,191 | A | * | 9/1925 | Bahlmann | 124/26 |
| 1,638,283 | A | * | 8/1927 | Bahlmann | 124/26 |
| 2,934,056 | A | * | 4/1960 | Lauterbach | 124/9 |
| 3,088,452 | A | * | 5/1963 | Foster | 124/43 |
| 4,706,641 | A | * | 11/1987 | Cote et al. | 124/8 |
| 5,036,828 | A | * | 8/1991 | Heffer | 124/47 |
| 5,050,575 | A | * | 9/1991 | Killion | 124/8 |
| 5,406,928 | A | * | 4/1995 | Panara et al. | 124/8 |
| 5,771,874 | A | * | 6/1998 | Kohler | 124/8 |

(Continued)

FOREIGN PATENT DOCUMENTS

EP 0592344 4/1994

*Primary Examiner* — Melba Bumgarner
*Assistant Examiner* — Alexander Niconovich
(74) *Attorney, Agent, or Firm* — The Farrell Law Firm, P.C.

(57) ABSTRACT

Provided is a target launching machine having a circular section portion. The machine includes a launching arm rotatable about an axis of rotation and a bearing surface that accommodates a circular section portion of the target and includes an offset portion that is configured so that a spacing between a trajectory of the launching arm and the offset portion increases in a direction of rotation of the launching arm. The offset portion includes a portion having a circular profile about a portion axis that is offset relative to the axis of rotation and parallel to the axis of rotation. The offset between the portion axis and the axis of rotation has a non-zero component in a primary direction defined in a vertical plane, with the non-zero component positioned relative to the axis of rotation opposite the portion.

16 Claims, 4 Drawing Sheets

(56) References Cited

U.S. PATENT DOCUMENTS 5,857,451 A * 1/1999 Ciluffo et al. ..... 124/6
5,937,839 A * 8/1999 Nilsson et al. ..... 124/8
6,176,229 B1 * 1/2001 Patenaude ..... 124/8
6,276,350 B1 * 8/2001 Davey ..... 124/8
6,431,161 B1 * 8/2002 Gustafsson ..... 124/8
6,588,410 B1 * 7/2003 Graber ..... 124/8

* cited by examiner

TARGET LAUNCHING MACHINE

The present invention relates to a machine for launching targets for shooting and especially for archery.

This sport traditionally offers archers the opportunity to shoot on fixed targets. Besides, devices for launching targets adapted to the throwing of targets such as "clay pigeons" are also known. These devices generally include a rotating launching arm able to throw a target. During the launching, the target is placed, with its underside on a bearing surface guiding the throwing of the target. The contact between the target and the support area in combination with the launching arm makes it possible to adjust the target release trajectory.

There is a current need to improve the cooperation between the target and the bearing surface.

Whereas the current techniques primarily apply to guide the target when it is thrown by the arm, the present invention significantly improves the behaviour of the target after the throwing thereof. In particular, a significant increase in the throwing distance, for the same power of the rotating arm, as well as better stability in air of the thrown target, have been noted, thanks to the invention. More specifically, a high gyroscopic effect is noted during the throwing of the target by means of the invention and this even with light targets or even a damp environment for machines operating in the rain. To improve the behaviour of the target during the throwing thereof, the present invention implements a bearing surface of the target with an offset portion which is formed so as to preferably gradually move away the contact point between the target and the bearing surface relatively to the launching arm. Thus, the parameters of application of the thrust force from the launching arm onto the target during the movement thereof are changed so as to improve the behaviour of the target.

Other objects and advantages will become apparent from the following description which presents illustrative, but not restrictive, embodiments of the invention.

However, prior to this description, it should be noted that the invention relates to a target launching machine having a circular section portion, with said machine comprising a launching arm rotatable about an axis of rotation and a bearing surface of the circular section portion, characterized in that the bearing surface has an offset portion configured so that the spacing between the trajectory of the launching arm and the offset portion is increasing in the direction of rotation of the launching arm.

The offset portion is advantageously a concave element, the concavity of which is oriented toward the launching arm. More precisely, the concave potion may be arched.

The latter possibility enables an efficient construction of the bearing surface and a gradual spacing of the offset portion relative to the axis of rotation of the arm.

According to the invention, in one embodiment thereof, the target launching machine has a circular profile portion, with said machine including a launching arm rotatable about an axis of rotation and a bearing surface of the circular section portion, characterized in that the bearing surface has an offset portion configured so that the spacing between the trajectory of the throwing arm and the offset portion is increasing in the direction of rotation of the launching arm, and comprises a circular profile portion having an offset axis relative to the axis of rotation and parallel to the axis of rotation, the difference between the offset axis and the axis of rotation has a non-zero component in a primary direction defined by a diameter of the trajectory of the launching arm located in a vertical plane, with said component being positioned relative to the axis of rotation opposite the circular profile portion.

Optional characteristics, which can be added or used alternately, are introduced in the following:

- the offset portion comprises a circular profile portion having an offset axis relative to the axis of rotation and parallel to the axis of rotation,
- the circular profile portion covers an angular sector smaller than or equal to 90°,
- the difference between the offset axis and the axis of rotation has a non-zero component in a primary direction defined by a diameter of the trajectory of the launching arm located in a vertical plane, with said component being positioned relative to the axis of rotation opposite the circular profile portion,
- the component in the primary direction has a length between 10% and 60% of the radius of the circular profile portion,
- the component in the primary direction has a length equal to substantially 35% of the radius of the circular profile portion,
- the difference between the offset axis and the axis of rotation has a non-zero component in a secondary direction defined by a diameter of the trajectory of the launching arm located in a horizontal plane,
- the component in the secondary direction is oriented toward the side of the axis of rotation where the circular profile portion is located,
- the component in the secondary direction has a length between 2% and 10% of the radius of the circular profile portion,
- the component in the secondary direction has a length substantially equal to 5% of the radius of the circular profile portion,
- the length of the difference between the offset axis and the axis of rotation is between 2% and 90% of the radius of the circular profile portion,
- the launching arm comprises a thrust surface oriented so as to be parallel to the surface of the circular section portion of the target,
- the thrust surface is planar,
- the axis of rotation is included in the plane of the thrust surface,
- the launching arm comprises an elbow between the axis of rotation and the thrust surface,
- the thrust surface comprises anti-slip means,
- the launching arm is so configured that the distal end of the thrust surface is located in the vicinity of the circular profile portion in a throwing starting position,
- the bearing surface is angularly adjustable relative to the launching arm.

The appended drawings are given as examples and are not restricting the invention. They only show one embodiment of the invention and will enable easy understanding thereof.

Figure 3:
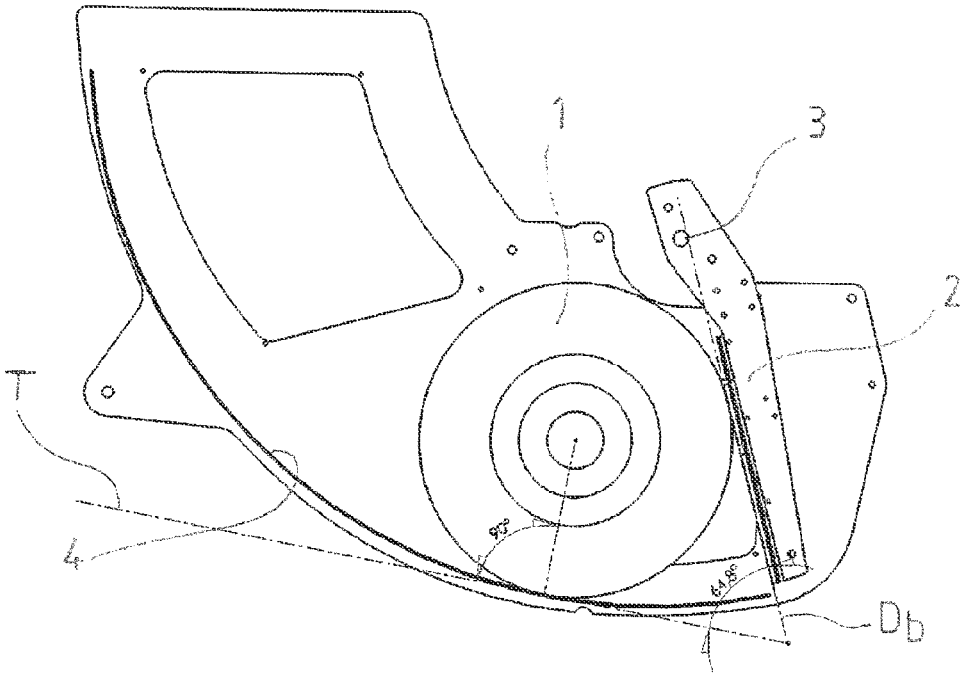
Figure 7:
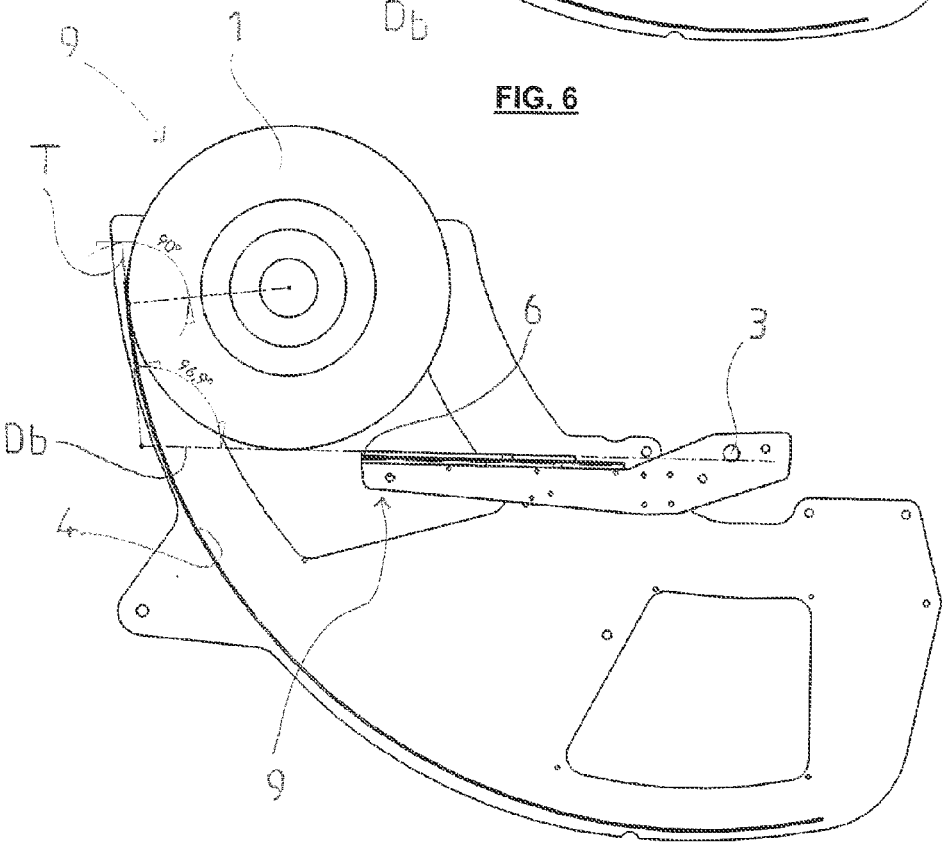

FIG. 3 and subsequent figures up to FIG. 7 show side views of the various stages of cooperation between a target to be thrown, the launching arm and the bearing surface.

The invention relates to a machine for launching targets more preferably for archery.

It should be noted that the present invention is particularly advantageous for machines used in combination with targets made of plastic material and particularly polymer foam. As a matter of fact, this type of plastic material generates cooperation with the machine which is different from that with clay pigeons. In particular, the risk of sticking is more important because the forces of friction with the machine parts are higher. On the other hand, whereas sticking may sometimes be solved simply by breaking clay pigeons using the launching arm, such a breaking clearing the trajectory of the launching arm is not possible with polymer foam targets.

The target 1 is preferably of the disc type, with a flat cylindrical, advantageously circular shape, having dimensions of the order of 30 to 150 mm in thickness, more preferably 245 mm in diameter and 50 mm in thickness for competition targets. Optionally, the target 1 may be a sandwich of multiple layers of polymer foam, in particular with a core layer thicker than the two other layers located laterally on either side of the core layer.

The target 1 has two substantially parallel faces and an edge corresponding to the thickness of the target. Both sides of the target may be flat or with a relief.

The machine may include a base which may be a welded structure although this is only one possibility and may be equipped with gripping means such as a handle and wheels for moving the machine. On the base is mounted a launching assembly mainly comprising a launching arm 2 mounted to rotate about an axis of rotation 3 defining a launching zone. Conventional operating means for rotating the launching arm 2 can also be used. Thus, the launching arm 2 may cooperate with a spring compressed by a motor and liable to be controllably decompressed to throw the target.

Figure 1:
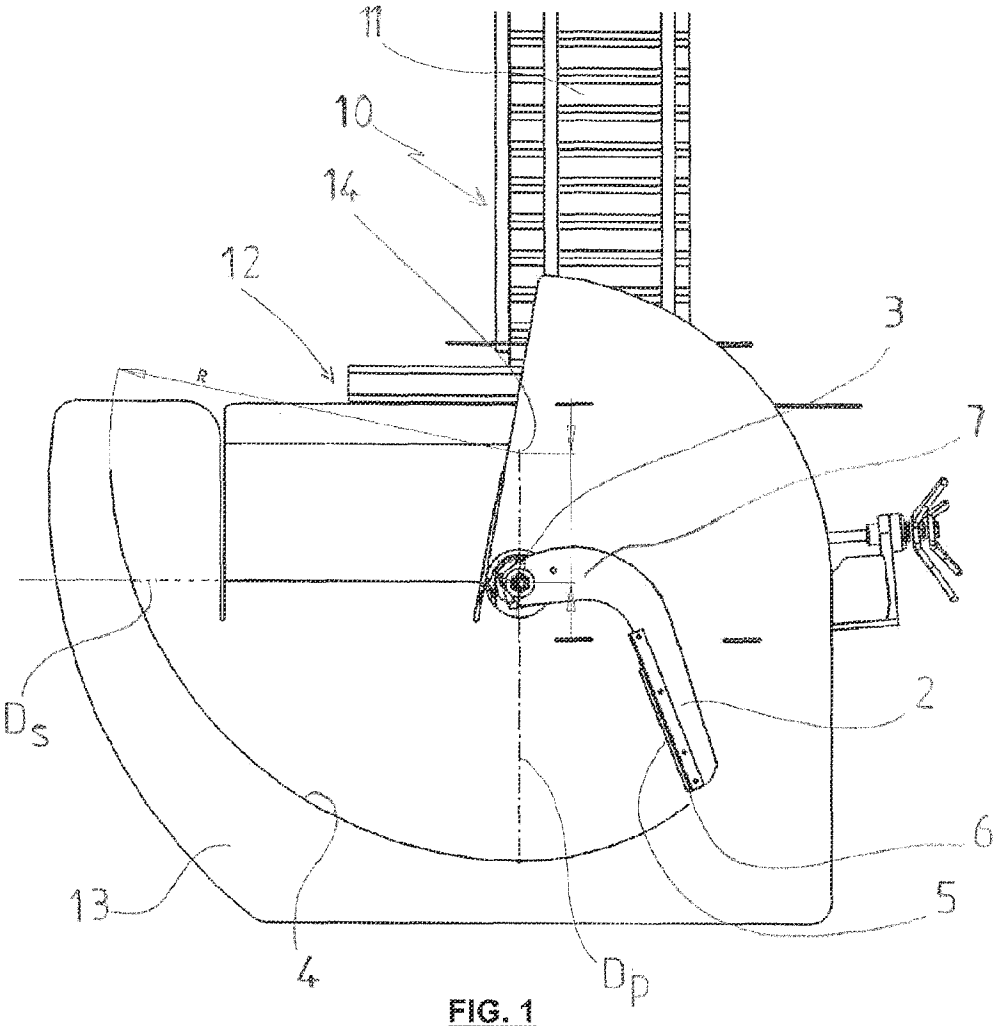
FIG. 1 shows a first embodiment of the invention showing a first configuration of the launching arm.

In the example shown in FIG. 1, a target 1 is fed in the launching area from a stack 11 of targets superposed in storage means 10, such as a column or a barrel having a plurality of columns for storing a larger number of targets. In the lower part of the storage means 10, a selective throwing system is provided in order to remove at least one target from the storage means 10. Then, the target(s) to be thrown is/are transferred, through a transfer zone, for example comprising a plurality of inclined surfaces acting like a slide adapted to feed the target(s) 1 to be thrown to the loading area. The loading area is described in greater details below.

Relative to a frame 13 of the machine, the loading area is preferably located in the lower part, the storage means and the transfer zone 10, 12 being- advantageously located in the upper part of the assembly. Thus, gravitation is taken advantage of during the step of loading the targets to be thrown. This configuration is however not restrictive and additionally or alternately, the target to be thrown is affected by the centrifugal force exerted by the launching arm 2.

In the case shown, the target 1 is a cylindrical element of circular cross-section throughout its thickness. However, other solutions can be considered provided that at least a portion of the section is circular so as to cooperate with the bearing surface 4 more particularly described below.

The bearing surface 4 is provided for receiving the target 1 to be thrown (described below is an embodiment in which a target is to be thrown but the invention may apply to the simultaneous throwing of a plurality of targets; in the latter case, the targets are juxtaposed and each one rests on the bearing surface 4, one of the targets being directly driven by rotation of the arm and driving the other targets by transmission of the force).

According to the invention, the bearing surface 4 not only aims at being a simple guide to the target 1 during the throwing motion implied by the rotation arm 2, but also provides a setting of the parameters of the application of the effort of the arm by means of a particular configuration of the positron thereof relative to the arm.

To this end, the bearing surface 4 has an offset portion configured so that the spacing between the trajectory of the throwing arm and the offset portion increases in the direction of the rotation of the launching arm 2.

In a preferred embodiment, the entire bearing surface 4 is formed by such an offset portion. This is the case illustrated in the various figures. Other solutions are also possible. In particular, a first part, in the direction of rotation of the launching arm 2, of the bearing surface 4 may have a certain configuration, whereas the offset portion is formed on the end of the trajectory of the target 1 in contact with the bearing surface 4.

Advantageously, the offset portion is formed with a curved and concave shape, the concavity being oriented toward the side of the launching arm 2. According to one possible embodiment, the distance between the offset portion and the launching arm 2 gradually increases with a constant derivative.

According to the embodiment illustrated in the various figures, the offset portion includes, or specifically in the case of figures consists of, a circular profile portion. Specifically, the circular profile portion is eccentric relative to the axis of rotation 3 of the launching arm 2. More specifically, the offset axis 14 of the circular profile portion is parallel to the axis of rotation 3 and at a distance from the latter.

FIG. 1 shows a first possible embodiment of the machine of the invention with a first configuration of the launching arm 2. In this case, the launching arm 2 comprises, at the free end thereof, a thrust surface 5 forming the area on which the arm 2 applies the throwing force to the circular section portion of the target 1. In the example suggested in the figures, the thrust surface 5 is flat and configured to be applied to the target 1 in parallel with the edge of the circular section portion of the target 1. In the illustrated case, the thrust surface 5 extends from the distal end of the launching arm 2 which is then also the distal end 6 of the thrust surface 5 towards the axis of rotation 3. For example, the length of the thrust surface 5 is indicatively 50% or more of the length of the arm between the distal end 6 thereof and the axis of rotation 3. Specifically, the embodiment of FIG. 1 shows a launching arm 2 provided with an intermediate portion between the portion in which the pivot about the axis of rotation 3 is located and the part with or constituting the thrust surface 5. This intermediate portion is shown by the elbow 7 in FIG. 1. The formation of such an elbow 7 makes it possible to adjust the relative position of the arms 2 and of the target 1 in particular in the starting position, i.e. at the beginning of the throwing motion. As an example, the distance formed by the elbow 7 between the direction of the thrust surface 5 and the parallel thereto passing through the axis of rotation 3 can be between 10 and 150 millimetres for a circular profile offset portion having a radius of the order of 500 to 600 millimetres.

As regards the arm 2, the bearing surface 4 ensures the optimal positioning of the target 1 relative to the fulcrum exercising the thrust of the launching arm 2 on the target in question. As mentioned above, the bearing surface 4 includes or is composed of an offset portion itself composed of or having a circular profile portion in the case shown. The illustrated circular profile has an axis 14 offset from the axis 3. Advantageously, the offset portion is formed as a sector of a cylinder centred on the axis 14. The materials which can be used for the bearing surface 4 are not limited, and may be a part made of metal or plastic material. According to an advantageous opportunity, the bearing surface 4 is selected so that it offers less friction by the target 1 than the launching arm 2 via its thrust surface 5. For example, the bearing surface 4 may comprise a portion of a curved metal sheet with an advantageously circular concave curved profile. At the same time, the thrust surface 5 preferably has means for increasing the friction on the target 1, such as elements in relief increasing the gripping strength or a selection of one or more high friction material(s) such as a portion of elastomeric or natural rubber. When providing for a greater friction at the thrust surface 5 and at the bearing surface 4, the rotary effect generated on the target 1 is primarily or essentially due to the contact with the launching arm 2. The parasitic effects of both simultaneous points of contact on the one hand between the target 1 and the launching arm 2 and on the other hand between the target 1 and the bearing surface 4 are thus limited.

One possibility consists in moving the arm 2 cyclically so that it runs at an angle of 360° in a launching cycle. More precisely, it operates with power mobility launching the target 1 in a first angular sector, preferably of less than 180°. Then it returns to the initial position ready for a subsequent throwing in a second angular sector supplementary to the first one. During the throwing motion, the bearing surface 4 is configured to provide a contact to the target 1 in order to adjust its position. Advantageously, this contact occurs in an angular sector of about 90° and advantageously of less than or equal to 90°. For example, the primary direction Dp which may, for example, be oriented in a vertical plane and correspond to a reference direction in the early movement can be taken as a first reference.

Figure 2:
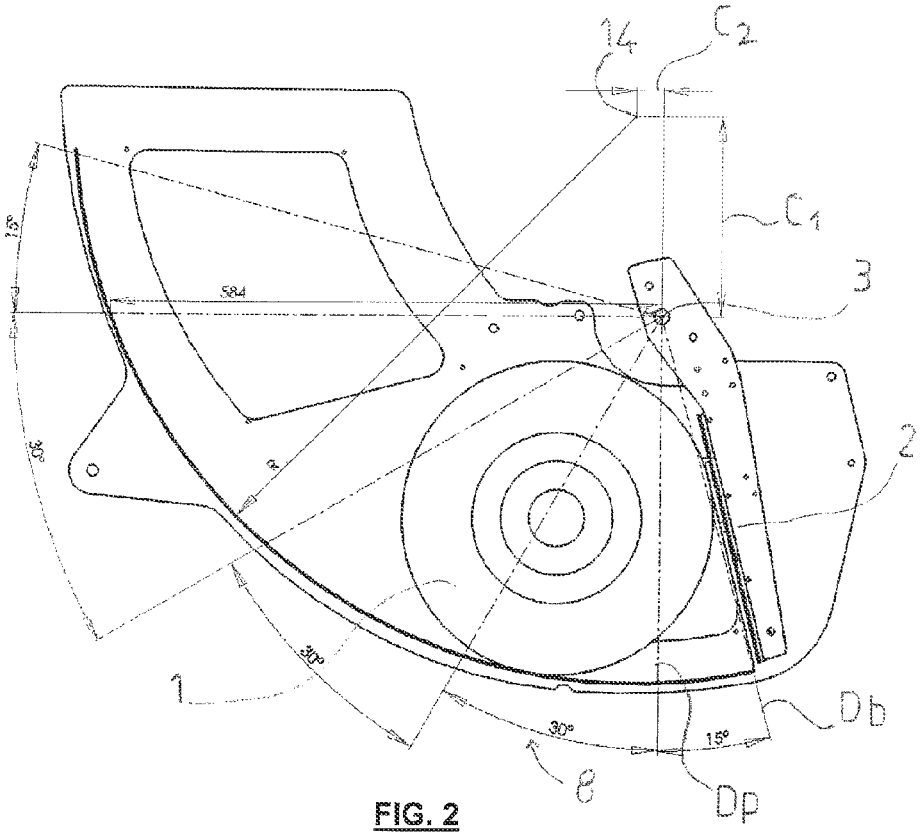
FIG. 2 shows a second embodiment with a modified launching arm.

FIG. 2 shows the positioning of a target 1 and a launching arm 2 in the primary direction Dp. More specifically, the target is in contact there with the bearing surface 4 located on one side of the primary direction Dp, whereas the launching arm 2 is located on the other side of the direction Db. The bearing surface 4 on which the target 1 is therefore effectively in contact begins slightly downstream of Dp relatively to the rotational direction of the launching arm 2.

Referring again to FIG. 1, the direction Db is oriented substantially vertically and constitutes the offset direction between the axis of rotation 3 and the offset axis 14 of the circular profile of the offset portion. The axis 14 is thus parallel and placed above, away from the axis 3. The component of this offset oriented in the direction Db is referenced C1. In the case shown in FIG. 1, this component is the sole component of the offset of the eccentric configuration of the offset portion. For example, the value of this offset may be between 10 and 60% of the radius of the circular profile portion and more advantageously substantially 35% of this radius.

FIGS. 2-7 show another embodiment with a different configuration of the launching arm 2. In this case, the launching arm 2 is configured so that the thrust surface 5 is oriented in a plane including or adjacent to the axis of rotation 3. FIG. 2 illustrates the direction Dp through the axis 3. Moreover, in this example, which can be combined however with the formation of a launching arm 2 with an angled portion 7, the offset, between the axis 3 and the axis 14 includes a component C1 having a position equivalent to that described for the embodiment shown in FIG. 1 and a component C2 perpendicular to the component C1 i.e. oriented so as to be included in a substantially horizontal plane in a preferred embodiment. Advantageously, the length of the component C1 is greater than the component C2, In addition, the component C2 may have a length between 2% and 10% of the radius of the circular profile portion, and more advantageously a length of the order of 5% of this radius. According to an additional or alternative option, the component C2 is also oriented on the rotation axis 3 side where the circular profile portion is located, namely towards the left of the rotation axis 3 in the configuration of the Figures.

The gradual separation between the offset portion of the bearing surface 4 and the launching arm 2 makes it possible to modify the contact area between the target 1 and the thrust surface 5 during the rotation of the arm 2. In a preferred embodiment, the distal end 6 of the thrust surface 5 is located adjacent to the offset portion at the start position of the throwing, substantially near the primary direction Dp, corresponding to the start position 8 illustrated in FIG. 2. During the rotation of the arm during the throwing, the distal end 6 tends to move away from the bearing surface 4 as shown by the successive FIGS. 3-7 up to a position completing the release of the target 1 out of the bearing surface 4.

To achieve this gradual motion, at least one target 1 is first delivered from the storage means 10 at which the targets 1 are stacked. A transfer zone 12 ensures the movement of the target 1 in question toward the loading area at which the target 1 is brought into contact with the bearing surface 4 advantageously at the offset portion. A situation similar to that shown in FIG. 3 is then produced. The effect of gravity is countered by the presence of the bearing surface 4 to retain the target 1 by the circular section portion thereof (here by the edge thereof). On the other hand, the target 1 is in contact with the launching arm 2. Before the start of the throwing, the contact of the launching arm 2 is not necessary, but in order to avoid shocks, this contact should advantageously exist before the beginning of the thrust.

Figure 4:
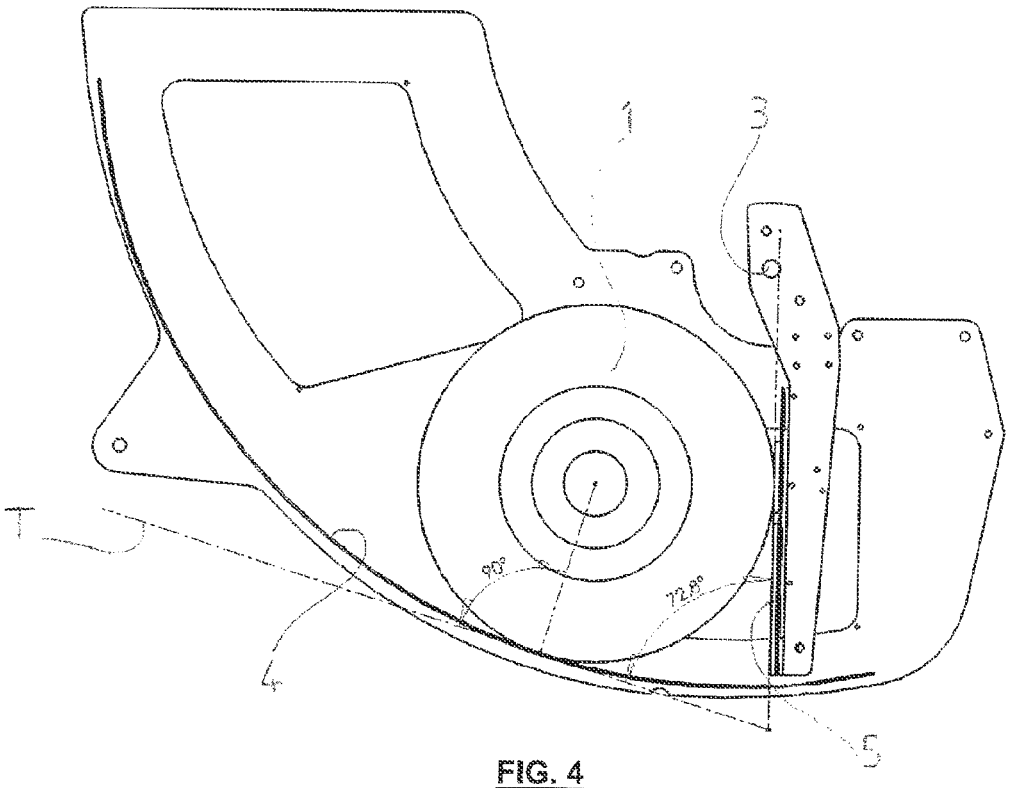

FIG. 3 shows the same configuration by illustrating the angle between the tangent T to the target 1 (and also tangent to the offset portion of the contact point of the target 1, the offset portion having here a circular profile) relatively to the direction Dp of the thrust surface 5. The angle between T and Dp is here for example of the order of 65° (64.8° in the illustration) corresponding to an acute angle involving a rather inward thrust direction relatively to the bearing surface 4. A subsequent stage of the rotation of the launching arm 2 is shown in FIG. 4 during which the direction Db is along the primary direction Dp. The target 1 has then moved somewhat along the bearing surface 4 in the direction of the rotation of the arm 2. The contact point of the bearing surface 4 with the target 1 being further apart in this configuration than in the previous one relative to the axis of rotation 3, the angle between the tangent T and the direction Db increases. A value of 72.8° is found in the case shown in FIG. 4.

Figure 5:
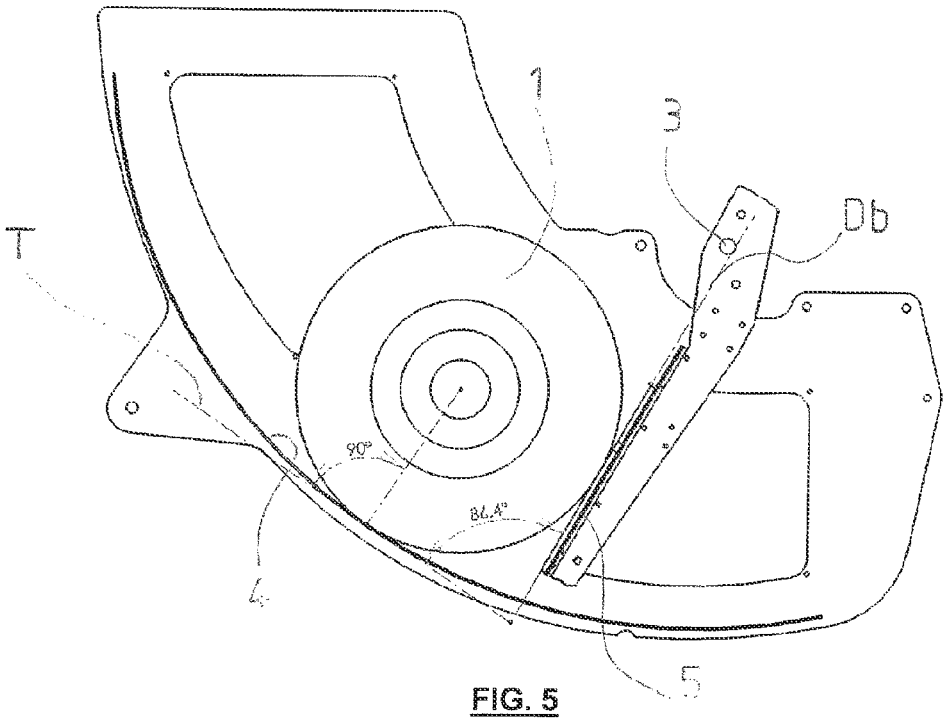
Figure 6:
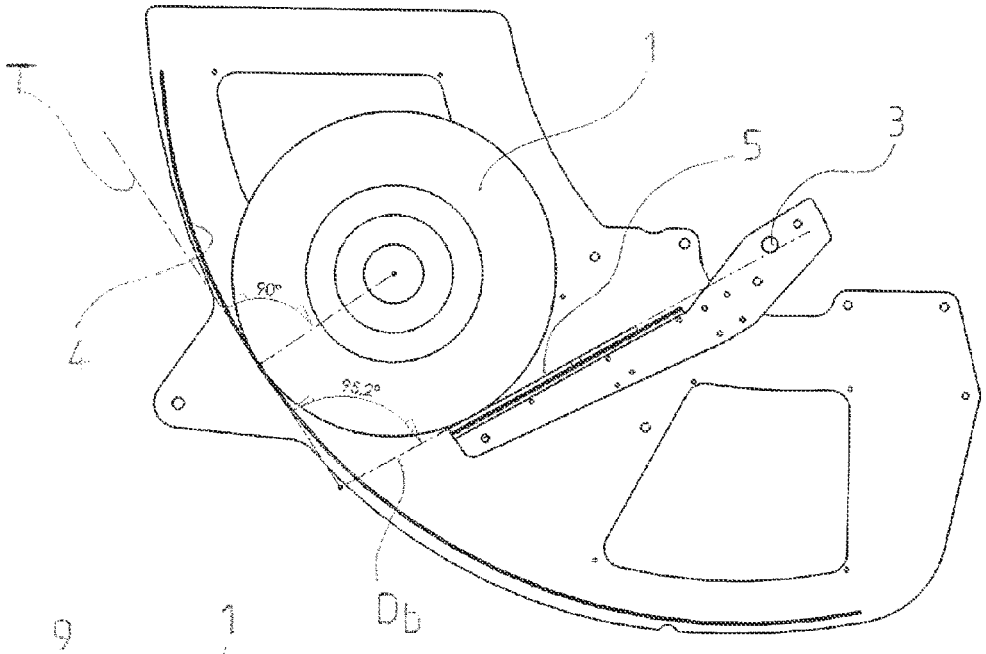

This trend continues in the case shown in FIG. 5, the arm 2 having continued rotating. The angle between T and Db is then 86.4°, the arm having travelled on an angular sector of 30° between the configuration of FIG. 4 and the configuration of FIG. 5. The launching arm 2 has travelled further on 30° in the case shown in FIG. 6. The angle between T and Db is then greater than 90°. It increases again in the case of FIG. 7, wherein the rotation is continued further on 30° to reach a value of 99°.

At the stage shown in FIG. 7, an end position 9 is reached at which the target 1 reaches the end of the bearing surface 4, so that the throwing out of the machine is obtained and the contact between the target and the bearing surface 4 ceases. Upon, completion of the throwing, the distal end 6 of the thrust surface 5 comes into contact with the target 1. Due to the particular configuration of the machine of the invention, the throwing is then finalized when a rotation of the target 1 has been generated. This promotes stability of the target in space and optimizes the throwing distance.

Advantageously, the gradual separation between the offset portion and the launching arm 5 is configured so that the angle between the tangent T and the direction Db changes from a value of less than 90° at the beginning of the throwing to a value greater than 90° at the end of the throwing.

Furthermore, the cooperation between the launching arm 2 and the target 1 is preferably configured so that the direction of the thrust at the point of contact between the target 1 and the thrust surface 5 is located, depending on the diameter of the target 1, at the circular section portion thereof or above a diameter of the target 1 passing through the point of contact between the target 1 and the thrust surface 5, opposite the area where the bearing surface 4 is in contact with the target 1. I.e., it is preferable for the contact point between the target 1 and the thrust surface 5 to be the furthest from the area where the bearing surface 4 is in contact with the target 1.

In practice, this configuration makes it possible to produce a counter-clockwise rotation effect in the cases illustrated, i.e. in the direction of rotation of the target 1 on the offset portion. According to another possibility, the offset portion is angularly adjustable so as to adjust the exit position of the target 1 to be thrown. Thus, by pivoting the bearing surface 4, the offset portion may be more or less inclined relative to the rest of the machine so that the end of the offset portion is located more or less high and more or less inclined vertically. For example, in the case shown in FIGS. 1-7, the output of the target 1 is substantially upright with the tangent to the offset portion at the final end of the bearing surface 4 being substantially vertical. The counter-clockwise pivoting of the bearing surface 4 about its axis 14 would make it possible to differently guide the tangent to the bearing surface 4 at the exit of the target 1 in order to tilt the throwing angle relative to the vertical. In an extreme case, the effective offset portion (i.e. the length of the portion on which the target is effectively supported) is limited, so as to throw the target in a substantially horizontal angle.

In the examples mentioned and the entire description, the vertical direction means the direction along the orientation of the gravitational force, with the horizontal direction being perpendicular to the vertical direction, along the line of the horizon.

It should be noted that the radius of the circular profile of the offset portion is advantageously greater than the length of the arm between the distal end and the axis of rotation 3 thereof.

It should be noted that the bearing surface 4 presses the target advantageously located in a plane perpendicular to the direction of rotation of the launching arm 2. In addition, the axis of rotation of the launching arm may include a non-zero vertical component or a non-zero horizontal component.

Still advantageously, the length of the launching arm between the axis of rotation 3 and the distal end 6 (advantageously end of both the thrust surface 5 and the body of the launching arm 2) is of the order of 300 to 450 millimetres. In this configuration, a circular profile offset portion advantageously has a radius R of the order of 450 to 650 millimetres. With such values, in the embodiment of FIG. 1, a component C1 of the offset between the axis 3 and the axis 14 of the order of 150 to 200 millimetres is satisfactory.

In the embodiment of FIGS. 2-7, a component C1 of the order of 210 millimetres and C2 of the order of 25 to 30 millimetres is satisfactory.

Still advantageously, as regards the primary direction Dp, the beginning of the offset area where the contact with the target 1 and the bearing surface 4 is effective is offset by 10 to 20° in the direction of the rotation of the launching arm 2. The end of the bearing surface 4 is advantageously less than 100° from the beginning of the surface and advantageously in an angular sector of less than 90°.

REFERENCES

1. Target
2. Launching arm
3. Axis of rotation
4. Bearing surface
5. Thrust surface
6. Distal end
7. Elbow
8. Start position
9. Final position
10. Storage means
11. Stack
12. Transfer zone
13. Frame
14. Offset axis
Dp: Primary Direction
Ds: Secondary Direction
R: Radius
C1: vertical component
C2: horizontal component
T: tangent to the circular section portion
Db: Direction of the thrust surface (5)

The invention claimed is:

1. A machine for launching a target having a circular section portion, the machine comprising:
- a launching arm rotatable about an axis of rotation; and
- a bearing surface configured to accommodate the circular section portion of the target,
- wherein the bearing surface comprises an offset portion configured so that a spacing between a distal end of the launching arm and the offset portion increases in a direction of rotation of the launching arm, and
- wherein the offset portion includes a portion having a circular profile about a portion axis that is offset relative to the axis of rotation and parallel to the axis of rotation.

2. The machine of claim 1, wherein the portion covers an angular sector smaller than or equal to 90°.

3. The machine according to claim 1, wherein the difference between the portion axis and the axis of rotation has a horizontal component in a secondary direction in a horizontal plane.

4. The machine according to claim 3, wherein the horizontal component is oriented toward a side of the axis of rotation where the portion is located.

5. The machine according to claim 3, wherein the horizontal component has a length between 2% and 10% of a radius of the portion.

6. The machine according to claim 5, wherein the horizontal component has a length substantially equal to 5% of the radius of the portion.

7. The machine according to claim 1, wherein a length of the offset between the portion axis and the axis of rotation is between 2% and 90% of a radius of the circular profile of the portion.

8. The machine according to claim 1, wherein the launching arm includes a thrust surface oriented parallel to the bearing surface of the circular section portion of the target.

9. The machine according to claim 8, wherein the thrust surface is planar.

10. The machine according to claim 9, wherein the axis of rotation is included in a plane of the thrust surface.

11. The machine according to claim 8, wherein the launching arm includes an elbow between the axis of rotation and the thrust surface.

12. The machine according to claim 8, wherein the thrust surface comprises an anti-slip means.

13. The machine according to claim 1, wherein the bearing surface is angularly adjustable relative to the launching arm.

14. The machine according to claim 1, wherein the offset between the portion axis and the axis of rotation has a non-zero component in a primary direction located in a vertical plane, with said non-zero component being positioned relative to the axis of rotation opposite the portion.

15. The machine according to claim 14, wherein the non-zero component in the primary direction has a length between 10% and 60% of a radius of the portion.

16. The machine according to claim 15, wherein the non-zero component in the primary direction has a length equal to substantially 35% of the radius of the portion.

* * * * *